US005747711A

United States Patent [19]

Cavaness et al.

[11] Patent Number: 5,747,711

[45] Date of Patent: May 5, 1998

[54] BODY FOR STRINGED MUSICAL INSTRUMENT

[76] Inventors: Jack D. Cavaness, 107 Shady Dr., Hendersonville; Deanne E. Cavaness, 1030 Woody La., Goodlettsville, both of Tenn. 37075

[21] Appl. No.: 617,684

[22] Filed: Mar. 19, 1996

[51] Int. Cl.[6] ..... G10D 3/00

[52] U.S. Cl. ..... 84/291; 84/293; 84/227; 84/267; 84/464 R

[58] Field of Search ..... 84/291, 293, 292, 84/267, 327, 464 R

[56] References Cited

U.S. PATENT DOCUMENTS

| | | | |
|---|---|---|---|
| 4,144,793 | 3/1979 | Soika et al. | 84/291 |
| 4,815,355 | 3/1989 | Cavaness | 84/291 |
| 4,901,900 | 2/1990 | Goto | 84/327 |
| 5,396,823 | 3/1995 | Hoshino | 84/291 |

*Primary Examiner*—Cassandra C. Spyrou
*Attorney, Agent, or Firm*—Waddey & Patterson; Laura K. Thomas

[57] ABSTRACT

A clear stringed musical instrument body capable of receiving a substance such that the appearance of the instrument may be altered by changing the substance contained within the body. The body comprises a front, a back and sides defining a watertight interior. The front includes at least one opening into watertight means for housing electronic control components within the body, wherein the watertight means projects into the interior of the body and merges with the body. The body also includes means for filling and draining the body which comprises at least one hole formed on the body and a plug received within the hole. The body further includes means for attaching the body to a neck and means for attaching a strap to the body.

14 Claims, 6 Drawing Sheets

BODY FOR STRINGED MUSICAL INSTRUMENT

BACKGROUND OF INVENTION

1. Field of the Invention

The present invention relates generally to components for stringed instruments, but more particularly to bodies for electric guitars.

2. Description of the Related Art

The art to which the invention relates includes stringed musical instrument components. The material from which the body of a stringed instrument is constructed has a significant impact on the tone that the instrument produces in that the density of the material contributes to the sustain and quality of the tone generated. Thus, in constructing a stringed instrument, material selection is a major factor in attempting to create an instrument which will produce a true "dead" tone, i.e. one in which every note played has the same intensity. There are differences in the physical properties of every piece of wood, such as hard or soft grain, which make it very difficult for a guitar constructed of wood to produce a true "dead" tone.

Accordingly, the manufacturers of stringed instruments often coat instruments constructed of wood with a resin material in an effort to eliminate the effects of the physical properties of the wood on the tone produced by the instrument. In addition, colored resins are used to vary the appearance of the instruments.

Electric guitar bodies are available in a seemingly infinite variety of sizes, shapes and colors, each having its own unique sound. While the body of an electric guitar functions primarily to house electronic pickup equipment, the body material significantly affects the tone quality of the instrument. When the strings of the guitar are plucked, the body absorbs a certain amount of the vibration produced by the strings. The amount of absorption is a function of the material from which the body is constructed.

Because each guitar produces a unique tonal quality, guitar players are reluctant to change instruments when they find one that produces the tone quality that they are seeking. Thus, aesthetics must often give way to sound, as even the same style guitar may produce a different tonal quality. Moreover, repeated stripping, sanding and repainting the guitar body, which is often done to change the appearance of the guitar, is not only tedious, costly and time-consuming, but it can also cause the instrument to produce a different tone. Furthermore, the guitar is unavailable for use by the musician during the refinishing process.

Thus, if a guitar player wishes to change the look of his or her guitar, he or she must either subject the guitar to the rigors of repainting or refinishing, or maintain an inventory of different guitars to suit his or her varying tastes at the expense, however, of consistent tone quality.

The bodies of stringed musical instruments are typically constructed of high quality grades of wood in order to produce the desired acoustical characteristics. However, the manufacture of a conventional wood guitar body is both labor-intensive and costly. Accordingly, it is believed that plastic can be used in electric guitar construction to produce a more cost-effective guitar body having superior acoustical characteristics than one manufactured from even the highest quality wood. It is also believed that a watertight, plastic guitar body can be produced which affords a guitar player the flexibility to change the aesthetic effect of his or her instrument by merely changing the color of the liquid contained within the body rather than requiring that the body be repeatedly stripped, sanded and repainted, and yet capable of producing sound of a consistent quality.

U.S. Pat. No. 4,815,355, granted to Cavaness, which is incorporated by reference as if fully set forth herein, is directed to a color changeable electric guitar body comprising a clear plastic body having sides and an attached back defining a hollow interior, which is filled with a colored liquid. The body includes means for draining and refilling the body, and a plurality of boxes and plastic tubes mounted inside the hollow interior for housing electronics and wiring.

The list that follows is directed to other patents for guitars found in the related art.

| U.S. Pat. No. | Inventor |
|---|---|
| 2,588,101 | Finder |
| 4,144,793 | Soika et al. |
| 4,213,370 | Jones |
| 4,313,362 | Lieber |
| 4,334,452 | Morrison, III et al. |

Until now, it is believed that a stringed instrument body capable of being filled with a substance and capable of containing electronic control components in an interior watertight chamber has not been invented.

SUMMARY OF THE INVENTION

The present invention is directed to a body for a stringed instrument wherein the body is capable of being filled with a substance, particularly a liquid, such that the appearance of the body may be altered simply by changing the substance contained within the body. It is also contemplated that, in addition to being capable of containing a substance, the body be capable of receiving means, such as fiber optic strands, for illuminating the contents of the body.

The inventive body is preferably constructed of a clear, impact-resistant material such as polycarbonate. However, other translucent materials that are impact-resistant and capable of tolerating the stresses imparted to the body when the strings of the instrument are under tension are contemplated to be within the scope of the present invention. The body includes a front, a back and sides defining a hollow, watertight or airtight interior. The back and sides may be formed integrally with the front, or formed as individual components and attached together by mechanical means, such as fasteners, chemical means (i.e., chemically welded), or attached by other methods of plastic welding. Alternatively, attachment of the components by any other means that will produce a watertight or airtight interior is contemplated to be within the scope of the present invention.

The front of the body includes at least one opening into watertight means for receiving electronic control components, including electronic pickups, a bridge or tremelo, volume and tone controls, pickup control switches, an output jack, etc. The scope of the present invention is not limited to any particular arrangement or layout of electronic control components. Accordingly, the openings in the front of the body can be arranged to accommodate any conceivable configuration of electronic components.

In the preferred embodiment, the watertight means comprises a watertight chamber projecting into the interior of the body from the openings. Alternatively, the chamber may comprise a cavity formed in the front of the body and projecting into the interior of the body. The chamber includes sides and a back plate, which may be formed integrally or may be formed separately and attached to the chamber by fasteners, chemical welding, or other suitable means.

In an alternate embodiment of the invention, the watertight chamber projects into the interior of the body and extends through the body to an opening in the back. A back plate is attached to the chamber at the back of the body such that the back plate is flush with the back of the body.

Yet another embodiment of the invention includes watertight means comprising a plurality of separate chambers opening into the interior of the body from the at least one opening in the front, wherein each chamber is configured to receive a particular electronic control component, such as a pickup, volume control, tone control, a tremolo, an output jack, etc. The chambers are interconnected by a watertight conduit or canal-type chamber for receiving wiring.

In another embodiment of the invention, the watertight means comprises a transverse opening extending through the body from the front to the back for housing electronic control components. The transverse opening includes side surfaces defining the boundaries of the opening. A pickguard and a back plate configured to cover the opening, are mounted on the front and the back of the body, respectively, to conceal electronic controls and wiring.

An alternate embodiment of the invention comprises an injection-molded body having a front and sides formed integrally therewith, and a back and sides formed integrally therewith. The front is attached to the back to form a hollow, watertight interior. While it is contemplated that the front be sonically welded to the back, other suitable means of attachment to form a watertight interior, such as chemical welding, are also considered to be within the scope of the present invention. The front of the body includes at least one opening into watertight means for housing electronic control components as set forth above. This embodiment may include a plurality of posts for receiving fasteners, such as screws, for fastening electronic components to the front of the body. The posts are preferably positioned about the perimeter of the at least one opening and extend transversely from the front to the back of the body.

The body also includes means for attaching a strap to the body. In the preferred embodiment, the strap attachment means comprises at least one strap button attached to the body.

The body includes means for filling and draining the body. The preferred embodiment of the filling and draining means includes fill and drain holes configured to receive plugs wherein the holes and plugs are integrally formed with the at least one strap button. However, it is contemplated that the filling and draining means include fill and drain holes and plugs formed separately from the at least one strap button. It is also contemplated that the filling and draining means include one hole and plug for accomplishing both the filling and draining functions.

The body also includes means for attaching the body to a neck of a guitar. In the preferred embodiment, the attachment means includes a recess formed on the body and configured to receive the neck. A plurality of posts, each having a hole for receiving a fastener is provided for attaching the neck to the body; however, other suitable means of attachment are contemplated to be within the scope of the present invention.

The body may also include a plurality of structural ribs positioned on the interior of the sides of the body adjacent the recess and extending inwardly into the interior of the body.

The embodiments of the present invention may, therefore, be summarized in a variety of ways, one of which is the following: a body for a stringed musical instrument, comprising a front, a back and sides rigidly attached to define a watertight interior; the front having at least one opening projecting into the interior of the body and merging with the body to form a watertight chamber for housing electronic control components within the interior of the body; means for filling and draining the body; and attachment means for attaching the body to a neck of the stringed instrument. The watertight chamber further comprises a back plate removably attached to the chamber.

The body further comprises at least one strap button mounted on the body for attaching a strap thereto.

The means for filling and draining the body further comprises a plug configured to be received within at least one hole formed in the body. The means for filling and draining the body may be integrally formed with the at least one strap button.

The means for attaching the body to the neck further comprises at least one fastener; and at least on post extending from a recess formed in the body, the at least one post having a longitudinal bore for receiving the at least one fastener.

Yet another way of summarizing the present invention is: a body for an electric guitar, comprising a front and a back rigidly attached at sides to form a hollow, watertight chamber; a watertight housing contained within the chamber for receiving electronic control components; wherein the front includes at least one opening into the housing; the body having at least one hole formed therein for filling and draining the body; a plug configured to be received within the at least one hole; and at least one fastener for attaching the body to a neck of the stringed instrument.

The watertight housing further comprises a plurality of separate chambers projecting into the body from at least one opening at the front of the body such that each chamber is suspended within the body and communicates with the body only at the opening from which it projects; and a conduit for interconnecting the plurality of chambers.

The body includes a plurality of posts, each being configured to receivea fastener, wherein the posts are positioned about the perimeter of the at least one opening in the front and extend transversely from an interior surface of the front to an interior surface of the back of the body.

The body may also include a plurality of structural ribs positioned on an interior surface of the sides of the body adjacent the recess and extending inwardly into the interior of the body.

The body further comprises means for attaching a strap to the body.

A third way of summarizing the invention is as follows: a clear plastic electric guitar body having sides formed therewith, a clear plastic back piece attached to the body at the sides and forming a hollow interior filled with a colored liquid for imparting a color to the body, and means for draining and refilling the interior, the improvement comprising a front having at least one opening into a watertight chamber for receiving electronic control components, wherein the chamber projects into the interior of the body and is contained within the body; and at least one fastener for attaching the body to a neck of the guitar.

The watertight chamber extends transversely through the body from the at least one opening in the front to an opening in the back of the body, the chamber further comprising a back plate attached to the chamber at the opening in the back of the body. Alternatively, the watertight chamber further comprises a transverse opening having side surfaces extending through the body from the front to the back; and a back plate for covering the opening at the back of the body.

It is an object of the present invention to provide a clear stringed instrument body capable of being filled with a substance such that the appearance of the body may be altered simply by changing the substance contained within the body.

It is a further object of the present invention to provide a clear electric guitar body of which the appearance can be altered without requiring that the body be repainted or refinished.

It is yet another object of the present invention to provide musicians with an economical means for changing the appearance of their stringed instruments by providing a clear body capable of receiving a variety of different substances which can be interchanged according to the particular tastes and desires of the musician.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENTS

Figure 1A:
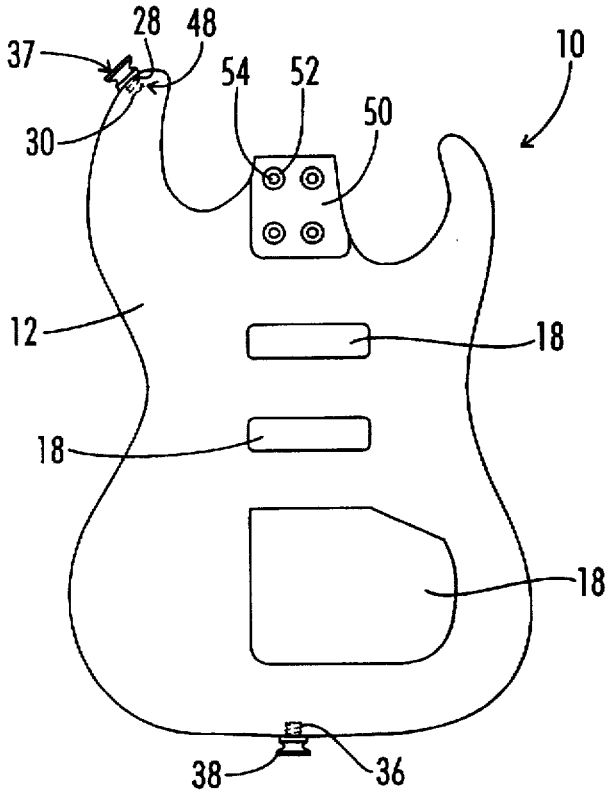
FIG. 1A is a front elevational view of an embodiment of the present invention.
Figure 1B:
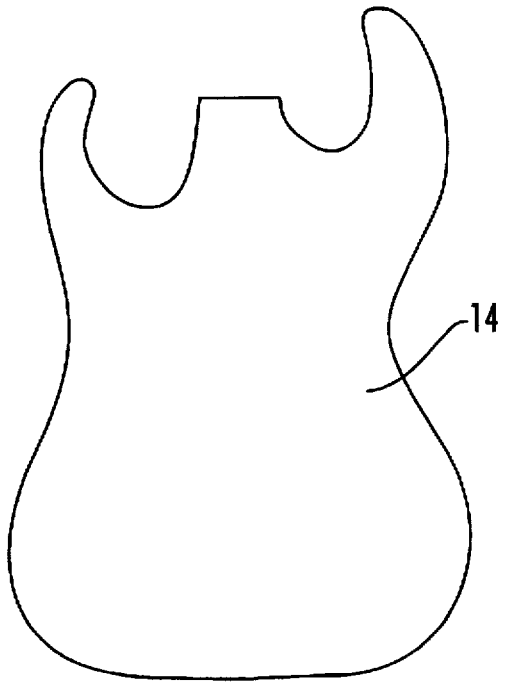
FIG. 1B is a rear elevational view of the embodiment of the invention shown in FIG. 1A.
Figure 1C:
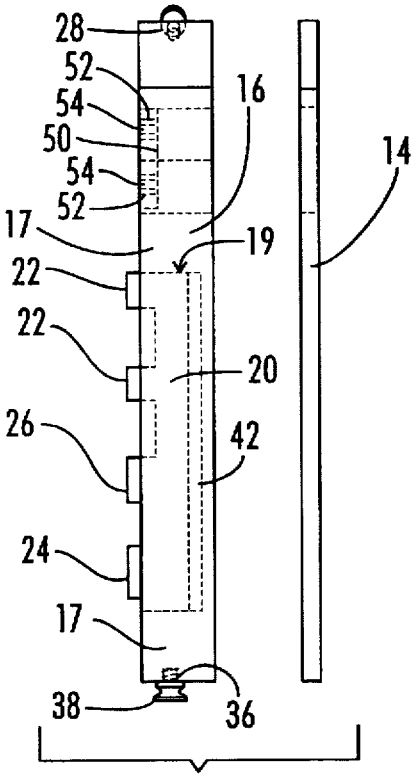
FIG. 1C elevational view of the embodiment of the invention shown in FIG. 1A.
Figure 1D:
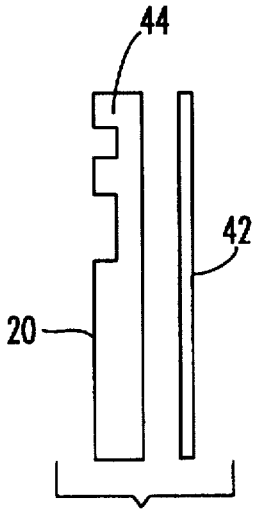
FIG. 1D is a sectional view of an embodiment of the watertight chamber for containing electronic control components within the body in the embodiment of the invention shown in FIG. 1A taken along lines 3—3.
Figure 1E:
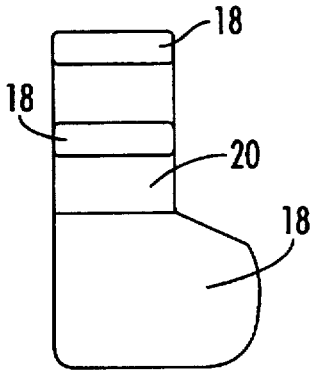
FIG. 1E is front elevational view of the watertight chamber.
Figure 2A:
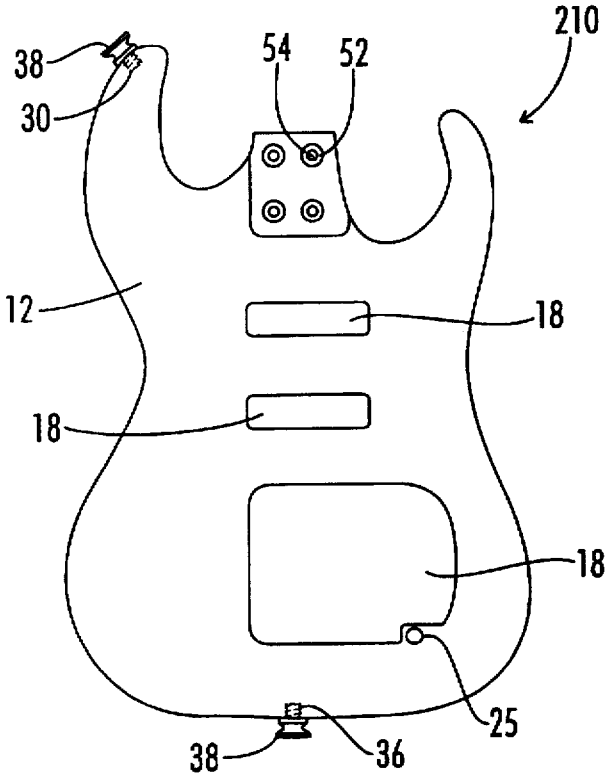
FIG. 2A is a front elevational view of an alternate embodiment of the present invention.
Figure 2B:
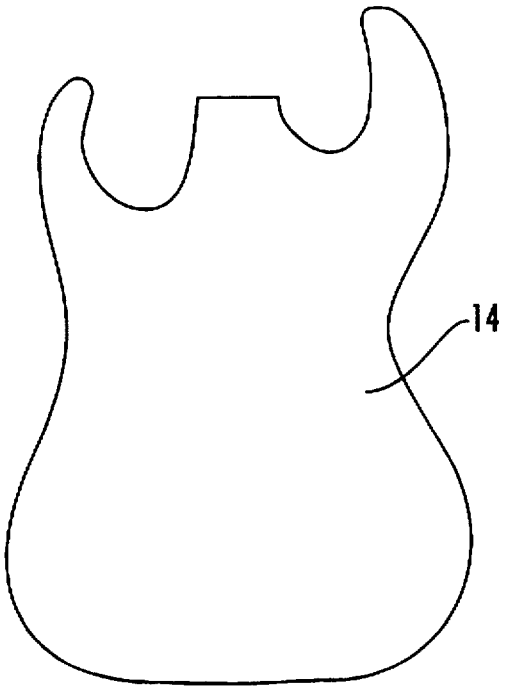
FIG. 2B is a back elevational view of the embodiment of the invention shown in FIG. 2A.
Figure 2C:
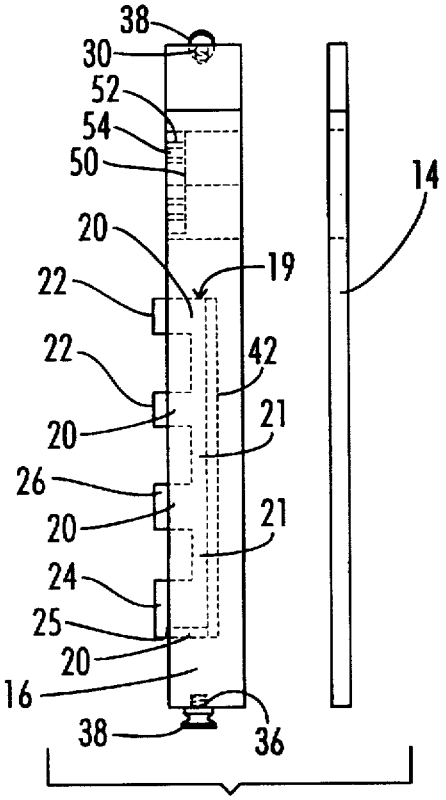
FIG. 2C is a side elevational view of the embodiment of the invention shown in FIG. 2A.
Figure 2D:
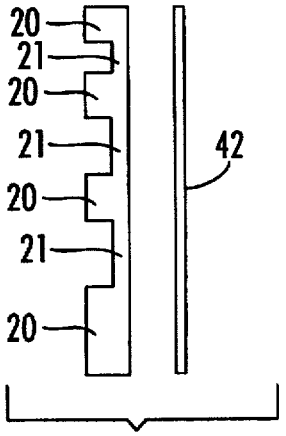
FIG. 2D is a sectional view of an embodiment of the watertight means for containing electronic control components within the body in the embodiment of the invention shown in FIG. 2A taken along lines 3—3.

An embodiment of the present invention is designated generally by the reference numeral 10 in FIGS. 1A, 1B and 1C. Embodiment 10 includes a body constructed of a clear, impact-resistant material. The body comprises a front 12, a back 14 and sides 16 defining a hollow, watertight interior 17. The back 14 and sides 16 may either be formed integrally with the front 12, or formed as individual components and welded together. Alternatively, attachment of the components by other suitable means, such as screws, to produce a watertight interior is contemplated to be within the scope of the present invention.

With reference to FIG. 1A, the front 12 of the body includes at least one opening 18 (three are shown) into watertight means 19 for containing electronic control components 26. The openings are configured to receive electronic pickups 22, a tremelo 24, and other electronic control components 26, such as volume and tone controls 23, pickup control switches and an output jack 25. A pickguard 27 configured to cover at least one opening 18 is mounted on the front 12 of the body to conceal electronic controls and wiring. While openings 18 for two pickups 22 are shown in FIG. 1A, other pickup configurations are contemplated to be within the scope of the present invention. Accordingly, the openings 18 in the front 12 of the body can be arranged to accommodate a variety of configurations.

In the preferred embodiment, the watertight means 19 comprises a watertight chamber 20 projecting into the interior 17 of the body from the openings 18 (see FIGS. 1A and 1C). The chamber 20 includes sides 44 and a back plate 42 attached thereto. In the preferred embodiment, the chamber 20 communicates only with the front 12 of the body at the openings 18. Accordingly, the chamber 20 is essentially suspended within the body from the openings 18. Alternatively, the chamber 20 may comprise a cavity formed in the front 12 of the body and projecting into the interior 17 of the body.

In an alternate embodiment of the invention designated generally by the reference numeral 210 in FIGS. 2A through 2D, the watertight means 19 comprises a plurality of separate chambers 20. Each chamber 20 is configured to receive a particular electronic control component 26, such as a pickup 22, volume and tone controls 23, a tremolo 24, and other electronic control components 26. The chambers 20 are interconnected by a watertight conduit 21 for receiving wiring. A separate chamber 20 is provided for an output jack 25.

Figure 3A:
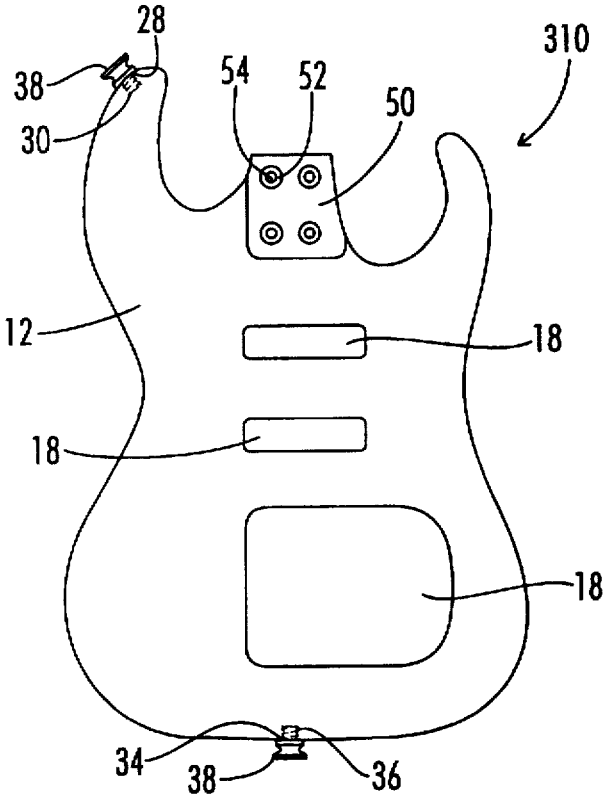
FIG. 3A is a front elevational view of an alternate embodiment of the present invention.
Figure 3B:
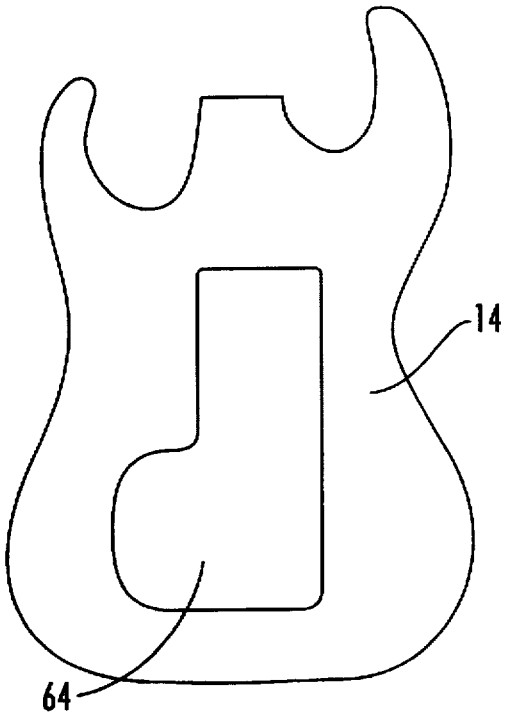
FIG. 3B is a rear elevational view of the embodiment of the invention shown in FIG. 3A.
Figure 3C:
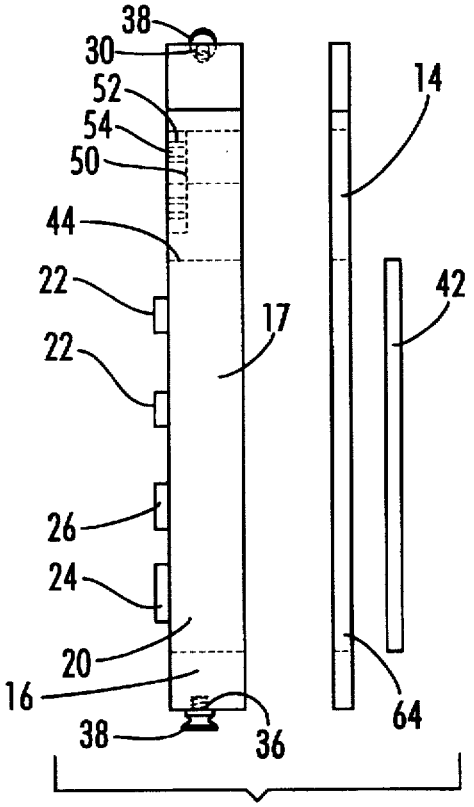
FIG. 3C is a side elevational view of the embodiment of the invention shown in FIG. 3A.

Yet another embodiment of the invention is designated generally by the reference numeral 310 in FIGS. 3A throught 3C. In this embodiment, the watertight chamber 20 projects into the interior 17 of the body from the openings 18 (see FIGS. 3A, 3B and 3C) and extends through the body to an opening 64 in the back 14. The chamber 20 includes sides 44 and a back plate 42 attached to the chamber 20 such that the back plate 42 is flush with the back 14 of the body.

Figure 4A:
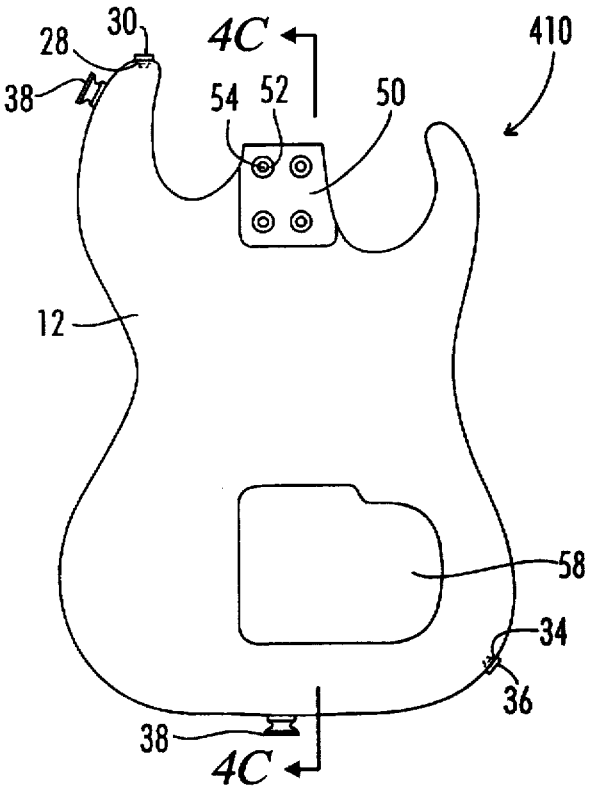
FIG. 4A is a front elevational view of an alternate embodiment of the present invention.
Figure 4B:
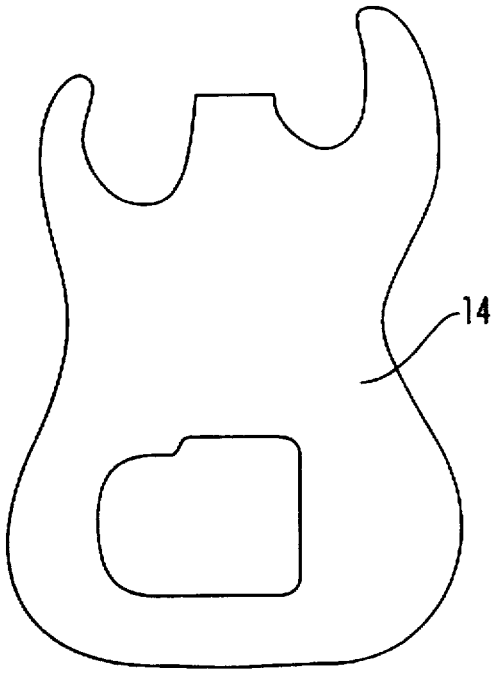
FIG. 4B is a back elevational view of the embodiment of the invention shown in FIG. 4A.
Figure 4C:
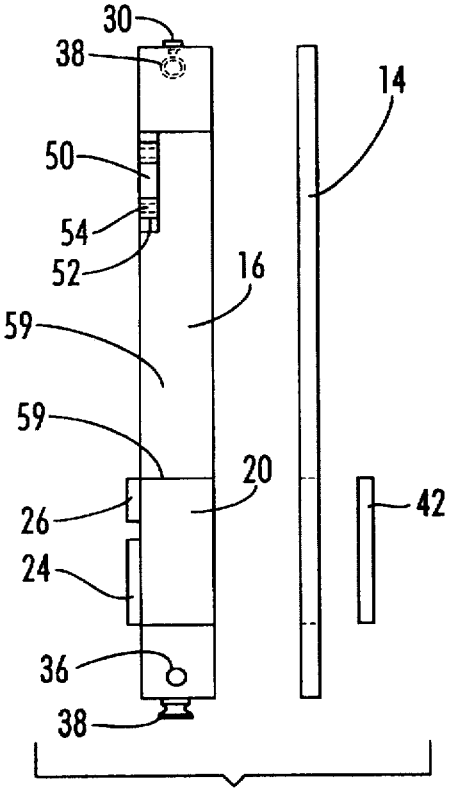
FIG. 4C is a sectional view of the embodiment of the invention shown in FIG. 4A taken along lines 4—4.
Figure 4D:
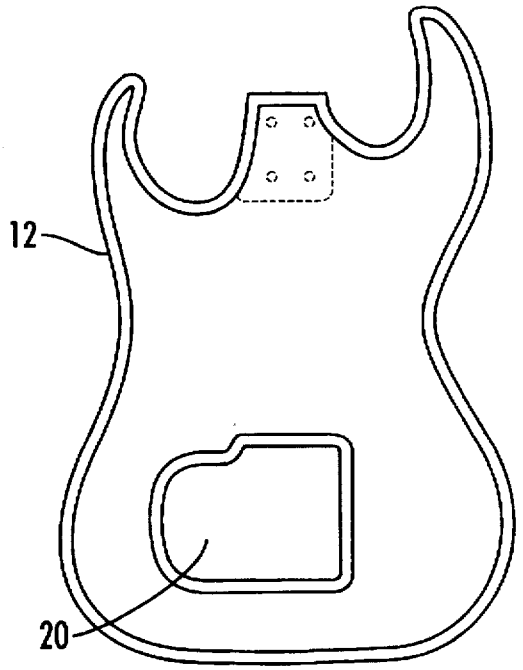
FIG. 4D is a rear elevational view of the interior of the front of the body shown in FIG. 4A.

In another embodiment of the invention designated generally by the reference numeral 410 in FIGS. 4A through 4D, the body comprises a front 12, a back 14, and sides 16 defining a hollow, watertight interior 17. With reference to FIG. 4A, the body includes a transverse opening 58 extending through the body from the front 12 to the back 14 for housing electronic control components 26, such as electronic pickups 22, volume and tone controls 23, a tremelo 24, and an output jack 25. The transverse opening 58 includes side surfaces 59 defining the boundaries of the transverse opening 58. A pickguard 27 and a back plate 42 configured to cover the transverse opening 58, are mounted on the front 12 and the back 14 of the body, respectively, to conceal electronic controls and wiring.

Figure 5A:
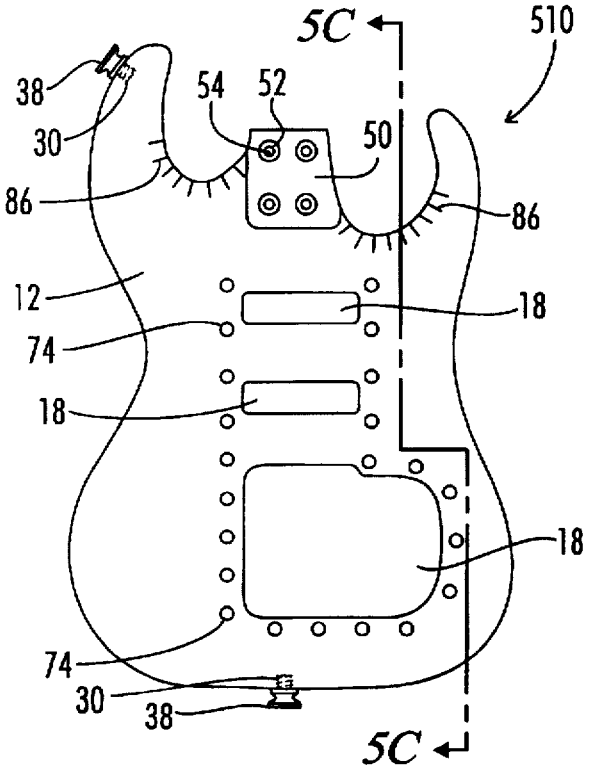
FIG. 5A is a front elevational view of an alternate embodiment of the present invention.
Figure 5B:
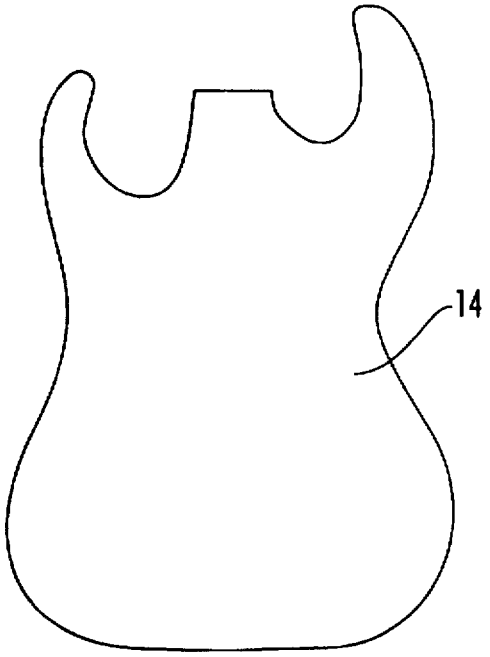
FIG. 5B is a back elevational view of the embodiment of the invention shown in FIG. 5A.

An alternate embodiment of the invention designated generally by the reference numeral 510 in FIGS. 5A through 5D comprises an injection-molded body having a front 12 and sides 16 formed integrally therewith, and a back 14 and sides 16 formed integrally therewith. The front 12 is attached to the back 14 to form a hollow interior 17. The sides 16 of the back 14 may include a flange extending along the periphery to provide a mating surface configured to be received within the sides 16 of the front 12 when the front 12 and the back 14 are attached to form the body. While it is contemplated that the front 12 be sonically welded to the back 14, other suitable means of attachment to form a watertight interior 17, such as chemical welding, are also considered to be within the scope of the present invention. With reference to FIG. 5A, the front 12 of the body includes at least one opening 18 (three are shown) into watertight means 19 for containing electronic control components 26 as set forth above. Similarly, a pickguard 27 configured to cover at least one opening 18 is mounted on the front 12 of the body to conceal electronic controls and wiring.

Figure 5C:
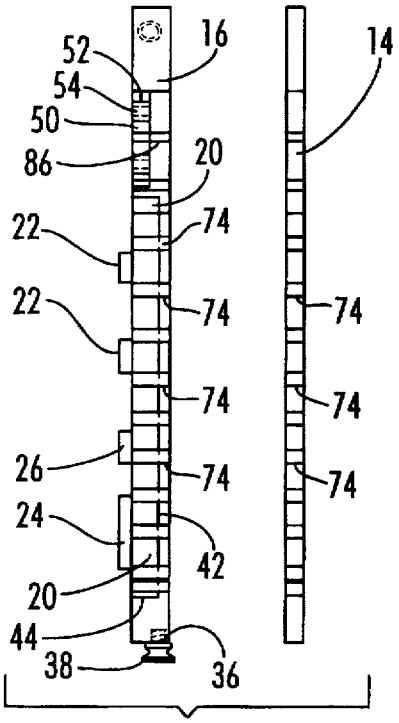
FIG. 5C is a sectional view of the embodiment of the invention shown in FIG. 5A taken along lines 5—5.
Figure 5D:
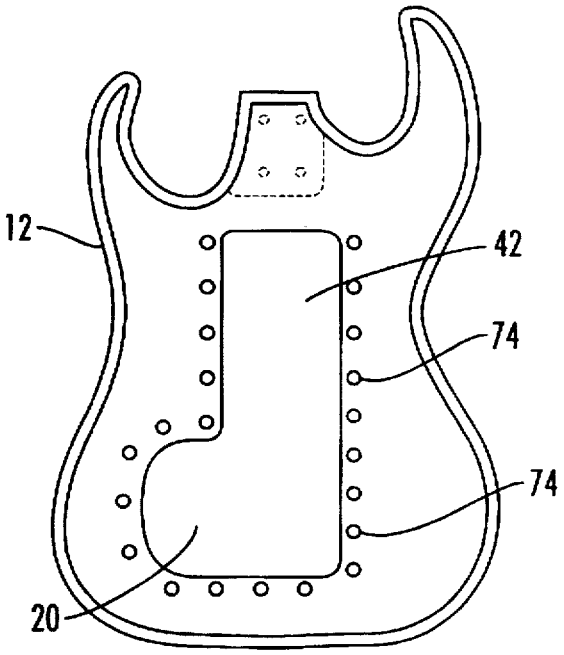
FIG. 5D is a rear elevational view of the interior of the front of the body shown in FIG. 5A
Figure 6A:
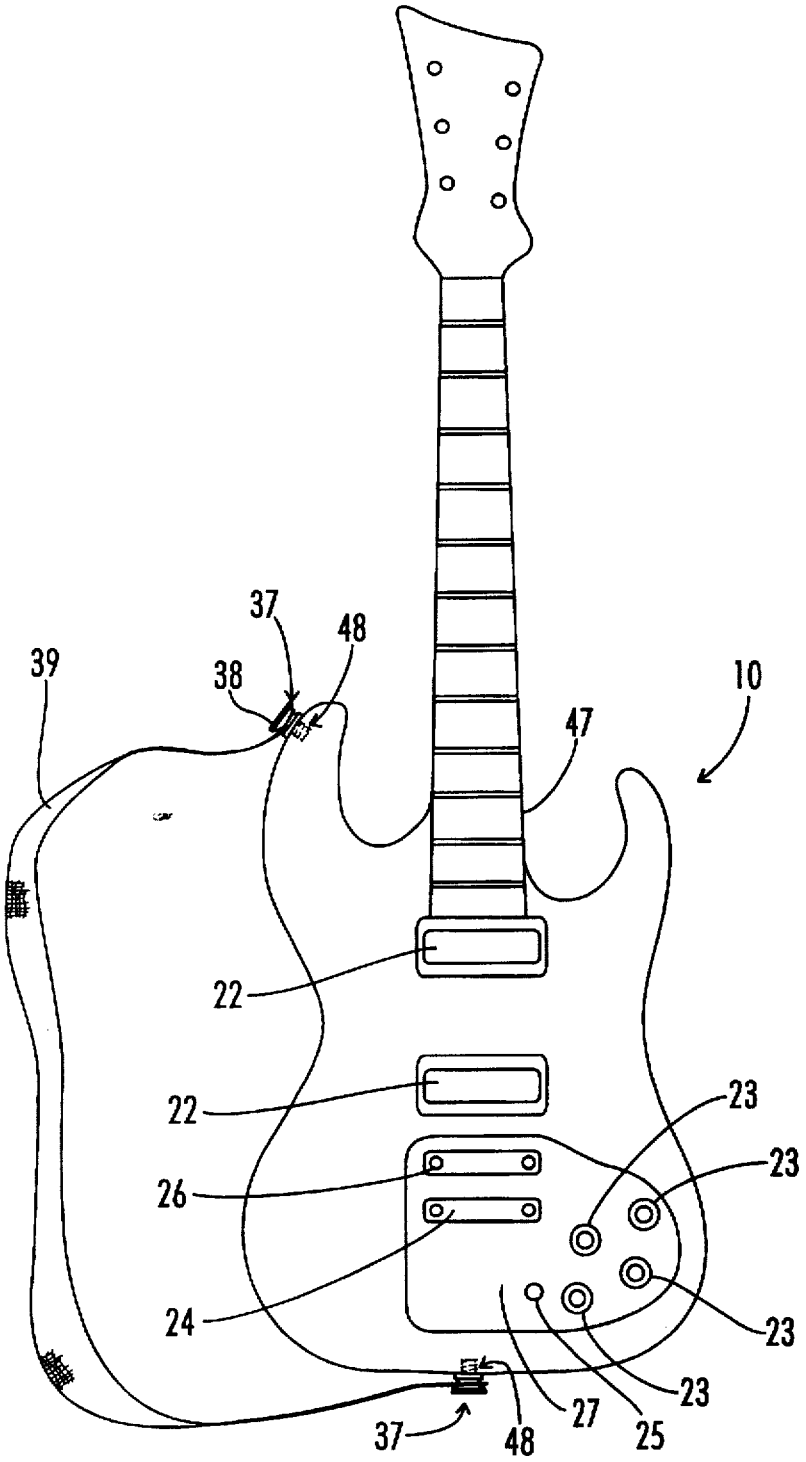
FIG. 6A is a front elevational view of a guitar incorporating the body of the present invention.
Figure 6B:
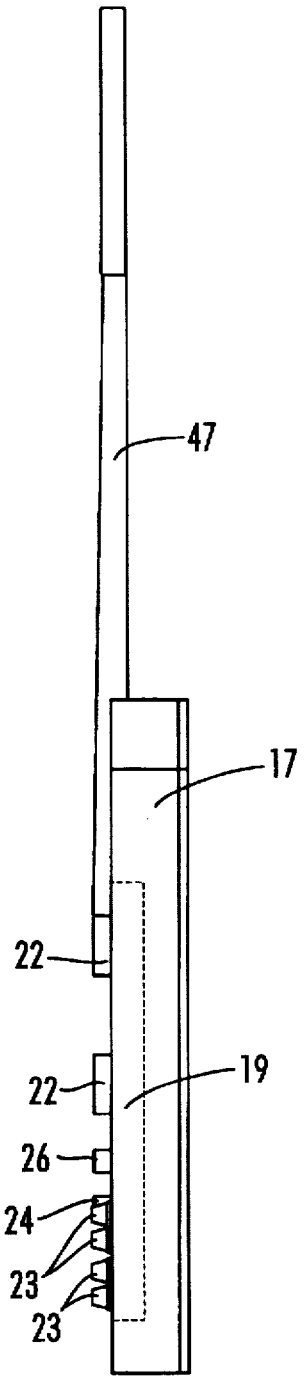
FIG. 6B is a side elevational view of a guitar incorporating the body of the present invention.

With reference to FIG. 5C, the watertight means 19 comprises a watertight chamber 20 projecting into the interior 17 of the body from the openings 18. As set forth above, the chamber 20 includes sides 44 and a back 42. The chamber 20 communicates only with the front 12 of the body at the openings 18, and is recessed within the body such that the chamber 20 is not immediately adjacent the front 12 or the back 14.

A plurality of posts 74 for receiving fasteners, such as screws, for fastening electronic components 26, including pickups 22 and a tremolo 24, and a pickguard 27 to the front 12 of the body are positioned about the perimeter of the at least one opening 18 and extend transversely from the front 12 to the back 14 of the body.

With reference to FIG. 1A, the body also includes means 37 for attaching a strap 39 to the body (see also FIGS. 2A, 3A, 4A and 5A). In the preferred embodiment, the strap attachment means 37 comprises at least one strap button 38 attached to the body.

With reference to FIGS. 1A and 1B, the body includes means 48 for filling and draining the body (see also FIGS. 2A, 3A, 4A and 5A). In the preferred embodiment, the filling and draining means 48 includes fill and drain holes 28 and 34, respectively, configured to receive plugs 30 and 36, respectively, wherein the holes 28 and 34, and plugs 30 and 36, are integrally formed with the at least one strap button 38. It is also contemplated that the filling and draining means 48 include one hole 28 and plug 30 for accomplishing both the filling and draining functions. In an alternate embodiment 410 shown in FIGS. 4A and 4B, the fill and drain holes 28 and 34, and the plugs 30 and 36, are formed separately from the at least one strap button 38.

With reference to FIG. 1A, the body includes means for attaching the body to a neck 47 of a guitar (see also FIGS. 2A, 3A, 4A and 5A). In the preferred embodiment, the attachment means includes a recess 50 formed on the body and configured to receive the neck 47. A post 52 having a hole 54 for receiving a fastener is provided for attaching the neck 47 to the body; however, other suitable means of attachment are contemplated to be within the scope of the present invention.

With reference to the embodiment of the invention designated generally by reference numeral 510 in FIG. 5A, the body includes a plurality of structural ribs 86 positioned on the interior of the sides 16 of the body adjacent the recess 50 and extending inwardly into the interior 17 of the body. The ribs 86 are preferably the same width as the sides 16 of the body at the point where the ribs 86 merge with the sides 16 and, from that point, the ribs 86 taper inwardly into the interior 17 of the body.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected by the appended claims.

What is claimed is:

1. A body for a stringed musical instrument, comprising:

a front, a back and sides rigidly attached to define a watertight interior;

the front having at least one opening projecting into the interior of the body and merging with the body to form a watertight chamber for housing electronic control components within the interior of the body;

means for filling and draining the body; and attachment means for attaching the body to a neck of the stringed instrument, wherein the attachment means further comprises at least one post extending from a recess formed in the body and at least one fastener, the at least one post having a longitudinal bore for receiving the at least one fastener.

2. The body of claim 1 wherein the watertight chamber further includes:

a back plate removably attached to the chamber.

3. The body of claim 1 wherein the means for filling and draining the body further comprises:

a plug configured to be received within at least one hole formed in the body.

4. The body of claim 1, further comprising:

at least one strap button mounted on the body for attaching a strap thereto.

5. The body of claim 4 wherein the means for filling and draining the body is integrally formed with the at least one strap button.

6. A body for an electric guitar, comprising:

a front and a back attached at sides to form a hollow, watertight chamber;

a watertight housing contained within the chamber for receiving electronic control components;

wherein the front includes at least one opening into the housing;

the body having at least one hole formed therein for filling and draining the body;

a plug configured to be received within the at least one hole;

at least one fastener for attaching the body to a neck of the stringed instrument; and a plurality of posts, each post having a bore for receiving one of said at least one fastener, wherein the posts are positioned about a perimeter of the at least one opening in the front and extend transversely from an interior surface of the front to an interior surface of the back of the body.

7. The body of claim 6 wherein the watertight housing further comprises:

a plurality of separate chambers projecting into the body from the at least one opening at the front of the body such that each chamber is suspended within the body and communicates with the body only at the opening from which it projects; and a conduit for interconnecting the plurality of chambers.

8. The body of claim 6, further comprising:

means for attaching a strap to the body.

9. The body of claim 6 wherein the body further includes:

at least one post extending perpendicularly from a recess formed on the body for receiving the neck, the at least one post having a bore formed therein for receiving the at least one fastener.

10. The body of claim 1 further comprising:

a plurality of structural ribs positioned along an interior surface of the sides of the body adjacent the neck and extending into the interior of the body.

11. A clear plastic electric guitar body having sides formed therewith, a clear plastic back piece attached to the body at the sides and forming a hollow interior filled with a colored liquid for imparting a color to the body, and means for draining and refilling the interior, the improvement comprising:

a front having at least one opening into a watertight chamber for receiving electronic control components, wherein the chamber projects into the interior of the body from the at least one opening and is contained within the body;

at least one fastener for attaching the body to a neck of the guitar; and means for attaching a strap to the guitar;

wherein the means for filling and draining the body and the means for attaching a strap to the body are integrally formed.

12. The body of claim 11 wherein the watertight chamber extends transversely through the body from the at least one opening in the front to an opening in the back of the body; and a back plate attached to the chamber at the opening in the back of the body.

13. The body of claim 11 wherein the watertight chamber further comprises:

a transverse opening having side surfaces extending through the body from the front to the back; and a back plate for covering the opening at the back of the body.

14. The body of claim 11 further comprising:

means for attaching a strap to the body.

* * * * *